US005097743A

United States Patent [19]

Hertzberg et al.

[11] Patent Number: 5,097,743

[45] Date of Patent: Mar. 24, 1992

[54] METHOD AND APPARATUS FOR ZERO VELOCITY START RAM ACCELERATION

[75] Inventors: Abraham Hertzberg, Bellevue; Adam P. Bruckner, Seattle; Carl Knowlen, Seattle; Keith A. McFall, Seattle, all of Wash.

[73] Assignee: Washington Research Foundation, Seattle, Wash.

[21] Appl. No.: 628,420

[22] Filed: Dec. 14, 1990

[51] Int. Cl.[5] ..... F41F 1/00

[52] U.S. Cl. ..... 89/7; 60/270.1; 89/8

[58] Field of Search ..... 60/270.1; 89/7, 8

[56] References Cited

U.S. PATENT DOCUMENTS

| | | | |
|---|---|---|---|
| 2,953,065 | 9/1960 | Brown | 89/1.7 |
| 3,213,802 | 10/1965 | Foa | 104/138 |
| 3,253,511 | 5/1966 | Zwicky | 89/1.7 |
| 3,357,306 | 12/1967 | Boyd et al. | 89/8 |
| 3,418,878 | 12/1968 | Stricklin | 89/8 |
| 3,459,101 | 8/1969 | Scanlon, Jr. et al. | 89/8 |
| 3,465,638 | 9/1969 | Canning | 89/8 |
| 3,880,044 | 4/1975 | Korr et al. | 89/8 |
| 4,722,261 | 2/1988 | Titus | 89/7 |
| 4,726,279 | 2/1988 | Kepler et al. | 89/8 |
| 4,932,306 | 6/1990 | Rom | 89/8 |
| 4,938,112 | 7/1990 | Hertzberg et al. | 89/7 |
| 4,982,647 | 1/1991 | Hertzberg et al. | 89/8 |

FOREIGN PATENT DOCUMENTS

| | | | |
|---|---|---|---|
| 248340 | 5/1987 | European Pat. Off. | 89/8 |
| 3808655 | 9/1989 | Fed. Rep. of Germany | 89/7 |
| 593583 | 8/1925 | France | 89/8 |

OTHER PUBLICATIONS

United Technologies Chemical Systems Division, "Tube-Accelerated Hypervelocity Projectile, A New Approach to High Muzzle Velocity Guns," Proprietary information, Presented to Defense Advanced Research Projects Agency, Jul. 1981, Exhibit A—Glasser Disclosure.

United Technologies Chemical Systems, Letter Dated 26 Aug. 1982 to Defense Advanced Research Projects Agency, Subject: Proposal No. 82-30, "Technology Demonstration of a Tube-accelerated Hypervelocity Projectile," Exhibit B—Meyerand Disclosure.

*Primary Examiner*—Stephen C. Bentley

*Attorney, Agent, or Firm*—Christensen, O'Connor, Johnson & Kindness

[57] ABSTRACT

A method and apparatus for initiating a ram acceleration of a projectile that is at rest. A projectile (34) is positioned in a starting chamber (14) of a launch tube (12). Starting chamber (14) is either filled with a gas at a relatively low pressure or is substantially evacuated. A wave reflection disk (42/42') is positioned a short distance behind the projectile. Downstream of the starting chamber are a plurality of segments, including a first segment (16), which is filled with a combustible gas mixture at a substantially higher pressure than that in the starting chamber. The first segment is separated from the starting chamber by a pair of thin membranes (20*a* and 20*b*). These membranes have a characteristic burst pressure that is about midway between the differential pressure in the first segment and the starting chamber. To initiate the ram acceleration process, fluid between the two membranes is exhausted to the atmosphere, sequentially exposing them to a differential pressure that exceeds their burst pressure. Bursting of these membranes enables the combustible gas mixture to expand unsteadily from the first segment into the starting chamber. An expansion wave produced by the expanding combustible gas mixture passes the projectile and reflects from the wave reflection disk as a shock wave. The wave reflection disk converts the kinetic energy of the expanding gas into thermal energy, at a temperature sufficient to initiate combustion of the mixture. The shock wave propagates downstream from the wave reflection disk, attaches to the projectile, and establishes a stable, thermally choked ram acceleration of the projectile down the launch tube. As the combustible gas mixture burns behind the projectile, the resulting pressure wave accelerates the projectile down the bore of the tube into successive combustible gas-filled segments.

20 Claims, 2 Drawing Sheets

METHOD AND APPARATUS FOR ZERO VELOCITY START RAM ACCELERATION

TECHNICAL FIELD

This invention generally pertains to a method and apparatus for accelerating a projectile to a supersonic velocity using a ram acceleration process, and more specifically, to a method and apparatus for initiating the ram acceleration process.

BACKGROUND OF THE INVENTION

In a conventional cannon, a projectile is accelerated by the rapid expansion of gases resulting from the explosive combustion of propellant chemicals. The muzzle velocity of a projectile shot from a cannon is generally only slightly greater than the initial acoustic velocity of the expanding gases. This limitation results because the ballistic efficiency of the chemical propellant charge decreases rapidly as the driving gas expends most of its energy in accelerating itself. Thus, the decreasing ballistic efficiency of an expanding propellant charge inherently limits the acceleration of a projectile through the bore of a conventional cannon.

To overcome the limitation on projectile velocity imposed by driver gasdynamics, a new method for accelerating projectiles has been developed that does not use an exploding propellant charge, but instead, continuously burns a combustible gas mixture to accelerate a projectile in a method referred to as "ram acceleration". This method is based on principles similar to those used in the air breathing ramjet engine, but is substantially different in many respects. For example, a ramjet engine carries with it a supply of fuel; in comparison, the projectile in a ram accelerator does not carry any propellant. Instead, the projectile travels through a tube filled with a mixture of gaseous combustible fuel and an oxidizer compressed to several atmospheres of pressure. The tube functions like the outer cowling of a ramjet, and the profile of the projectile has a shape much like the central body of a ramjet. As the projectile passes through the combustible gas mixture, the gaseous mixture flows past the "throat," i.e., the largest diameter portion of the projectile body, into a diffusion area disposed immediately behind the throat and burns in a combustion zone proximate the aft portion of the projectile. Combustion of the gaseous fuel process in a forward moving combustion zone, producing an increased pressure that accelerates the projectile down the bore of the tube. The ballistic efficiency of the ram acceleration process may be maintained at a high level by tailoring the combustible gas mixture in the tube to maintain the projectile Mach number within prescribed limits.

At least five modes of ram acceleration are theoretically possible in the ram accelerator, depending upon the profile of the projectile, its velocity, and other operational factors. In one of the modes, referred to as a "thermally choked mode," combustion of the gas mixture proceeds at subsonic velocities behind the projectile, accelerating the projectile to velocities in the range of from 0.7 to 3.0 kilometers per second. The thermally choked mode can be used to initially accelerate the projectile once the ram acceleration process is started. Then, by transitioning the projectile to one of the other modes, it can be accelerated to even higher velocities.

Muzzle velocities as high as 12 kilometers per second may thus be achieved.

Early problems with operating a laboratory test prototype ram accelerator in the thermally choked mode and the solutions to these problems are described in U.S. patent application Ser. No. 207,706, filed June 16, 1988, now U.S. Pat. No. 4,982,647. In that invention, as has typically been true of all ram accelerators, the projectile is preaccelerated to a supersonic velocity before it enters a portion of the tube filled with the combustible gas mixture. A shock wave caused as the projectile enters the combustible gas mixture is throttle to insure that its velocity is less than or equal to that of the projectile, thereby establishing a subsonic flow past the projectile to initiate a stable combustion zone proximate the aft end of the projectile.

The preferred method previously used for preaccelerating the projectile to supersonic velocities before it enters the combustible gas mixture employs a tank of compressed helium. The projectile is placed in a portion of the tube that has been evacuated, and a fast-acting valve is opened, allowing the compressed helium to expand into the evacuated portion of the tube behind the projectile. A sabot or disk that is slightly smaller in diameter than the bore of the tube is positioned immediately behind the projectile. The expanding helium forces the sabot and projectile to accelerate down the tube to a supersonic velocity. As the moving projectile perforates a membrane separating the evacuated portion of the tube from a first section that is filled with the combustible gas, it initiates thermally choked ram acceleration. To throttle the resulting shock wave sufficiently to provide a stable subsonic combustion zone behind the projectile, a perforated or relatively lightweight sabot is used. Alternatively, a port can be provided in the tube wall proximate where the projectile enters the portion of the tube filled with the combustible gas mixture, or other techniques can be employed to throttle the shock wave, as described in the above-referenced patent application.

The prior art teaches that a chemical propellant, e.g., an explosive charge, can also be used for preaccelerating a projectile to a supersonic velocity to initiate the ram acceleration process. To use a chemical propellant, the projectile is typically loaded into a breech capable of withstanding the pressure created by the explosive ignition of the chemical propellant and is fired into the first segment of the tube filled with combustible gas, just like an artillery shell. This technique for preaccelerating a projectile has its drawbacks, however. Ignition of the chemical propellant is likely to produce a substantial recoil. The weight of the breech and requirements for handling the recoil clearly impact on options for placement and mounting of the ram accelerator.

The above-described techniques for preaccelerating a projectile to initiate a ram acceleration process add to the complexity, size, weight, and logistical considerations involved in operating the ram accelerator. Accordingly, it is an object of the present invention to initiate ram acceleration of a projectile without preaccelerating it. It is further an object to "start" the ram acceleration process using an expanding combustible gas mixture. These and other objects and advantages of the present invention will be apparent from the attached drawings and the Description of the Preferred Embodiments that follow.

SUMMARY OF THE INVENTION

Apparatus for accelerating a projectile to a supersonic velocity using a ram acceleration process that starts with the projectile at rest (instead of being preaccelerated to a supersonic velocity) comprises a launch tube that is longitudinally divided into a plurality of segments along its length, including a first chamber in which the projectile is positioned at rest, and an adjacent second chamber filled with a combustible gas mixture. The first chamber is either evacuated or filled with a fluid having a substantially lower pressure than that of the combustible gas mixture that is within the second chamber. Separation means are provided for separating the first chamber from the second chamber. Also included are means for opening the separation means, allowing the combustible gas mixture contained therein to quickly expand into the first chamber from the second chamber. The expanding combustible gas mixture produces an expansion wave that travels upstream through the first chamber, passing the projectile at a supersonic velocity. Wave reflection means are disposed behind the projectile in the first chamber and are operative to reflect the expansion wave as a shock wave back toward the projectile. In addition, means for igniting the combustible gas mixture behind the projectile are provided. The reflected shock wave starts the ram acceleration process as it reaches the projectile, so that the burning combustible gas mixture continuously accelerates the projectile longitudinally down the launch tube.

The separation means in one embodiment preferably comprise a pair of thin membranes, closely spaced longitudinally along the launch tube. Each of the pair of membranes extends transversely across the launch tube. The pressure of a fluid disposed between the pair of membranes is between the fluid pressure in the first chamber and the pressure of the combustible gas mixture in the second chamber. Each membrane has a characteristic differential burst pressure that is substantially less than the difference between the pressure of the combustible gas mixture in the second chamber and the fluid pressure in the first chamber.

The means for opening preferably comprise valve means for reducing the pressure of the fluid between the pair of membranes, so that each membrane is exposed to a differential pressure substantially greater than its characteristic differential burst pressure. As a result, the pair of membranes is burst, enabling the combustible gas mixture to rapidly expand from the second chamber into the first chamber.

Alternatively, the separation means can comprise a material having a melting point less than an ignition temperature of the combustible gas mixture. In this case, the means for opening comprise a wire disposed on the diaphragm means and a selectively energized current source connected to the wire to electrically heat it above the melting temperature of the material comprising the diaphragm means, thereby perforating the material.

The wave reflection means comprise a disk disposed transversely across the launch tube behind the projectile. This disk can include at least one orifice loosely covered by a plate disposed on an upstream side of the disk (i.e., on aside opposite from that adjacent the projectile). The inertial mass of the plate is sufficient to reflect the shock wave back toward the projectile as the plate is blown clear of the disk. The means for igniting thus can comprise the one or more orifices in the disk and the plate; the orifice(s) restrict the flow of the combustible gas mixture. In addition, reflection of the expansion gas mixture into wave converts part of the kinetic energy of the combustible gas mixture into thermal energy. In this manner, the temperature of the expanding combustible gas mixture is raised above its ignition temperature.

The apparatus further includes means for preventing retrograde motion of the projectile within the launch tube as the expansion wave produced by the expanding combustible gas mixture passes the projectile, moving toward the wave reflection means. The means for preventing retrograde motion can comprise a plurality of thin vanes that engage the projectile so as to prevent it moving upstream within the first chamber.

A method for accelerating a projectile to a supersonic velocity using a ram acceleration process is another aspect of the present invention. The projectile is at rest as the acceleration process starts, and the method generally includes steps consistent with the functions implemented by the various elements of the apparatus as set forth above.

DESCRIPTION OF THE PREFERRED EMBODIMENTS

Figures 1, 2, 3, 4, 5, 6, 8:
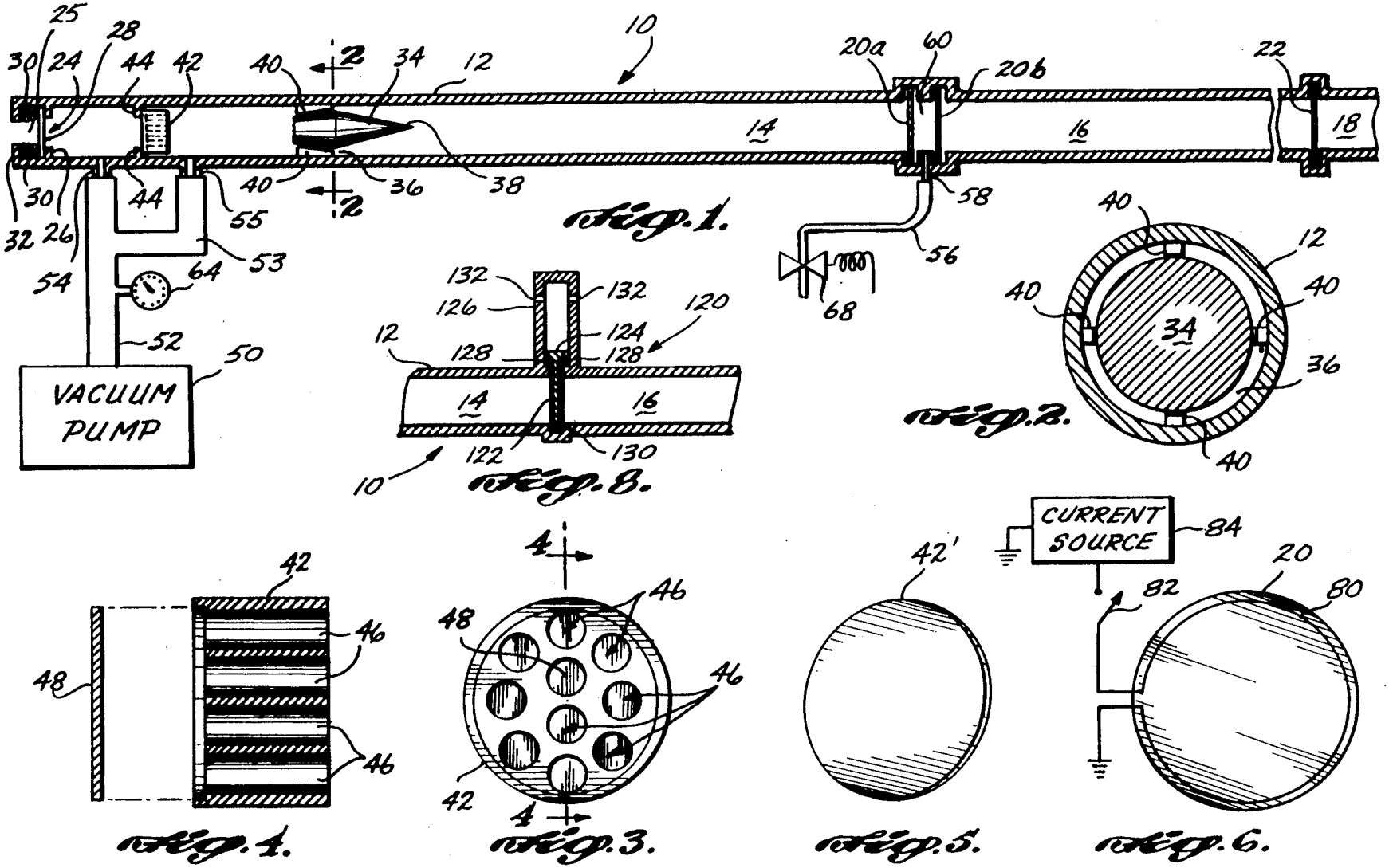
FIG. 1 is a schematic cross-sectional view of a first preferred embodiment of a ram accelerator configured for starting the ram acceleration process for a projectile having a zero velocity.
FIG. 2 is a cross section of the ram accelerator launch tube and projectile taken along Section line 2—2 of FIG. 1.
FIG. 3 is an end view of a perforated wave reflection disk used in the ram accelerator.
FIG. 4 is a cross-sectional view of the perforated wave reflection disk, taken along Section line 4—4 of FIG. 3.
FIG. 5 is an isometric view of an alternative lightweight wave reflection disk.
FIG. 6 illustrates an alternative embodiment of means for perforating a diaphragm to expand combustible gas into a starting chamber of the ram accelerator.
FIG. 8 is a schematic cross-sectional view of a portion of the launch tube showing a fast-acting wave used to selectively control the expansion of the combustible gas into the starting chamber.

In FIG. 1, a ram accelerator is shown generally at reference 10. Ram accelerator 10 includes a launch tube 12, which is divided into a starting chamber 14, a first segment 16, and a second segment 18. In this FIG., only portions of the first and second segments are shown. Launch tube 12 can include other segments (not shown ) downstream of second segment 18.

A pair of spaced-apart thin membranes **20*a* and 20*b* separate starting chamber 14 from first segment 16. A similar, but single thin membrane 22 separates first segment 16 from second segment 18. Membranes 20 and 22 expand transversely across the bore of launch tube 12, forming a fluid-tight seal between the adjacent segments of the launch tube. Successive segments downstream of second segment 18 are also separated from each other by thin membranes like membrane 22 so that combustible gas mixtures disposed within each of the segments are prevented from mixing. Membranes 20 and 22** preferably comprise Mylar TM. Other readily perforable materials, such as metal foil, may also used for this purpose.

An ignition relief valve 24 is disposed on the upstream or distal end of starting chamber 14. Within this valve, an annular flange 26 forms a fluid-tight seal against a valve plate 28. Valve plate 28 is urged into sealing contact with flange 26 due to a bias force provided by a plurality of helical springs 30. Springs 30 are disposed in a spaced-apart array around a lip 32, which holds them in place and defines an opening 25 to atmospheric pressure for ignition relief valve 24. Alternatively, the upstream end of starting chamber 14 can be closed off by a thin membrane (not shown) like membrane 22, or closed and ported using membrane covered vents (not shown), or connected to a large volume expansion chamber (also not shown) to contain the expanding gases resulting from initiation of the ram acceleration process.

A projectile 34 is disposed at rest within starting chamber 14, supported by a plurality of projectile-stop vanes 40, which extend radially inward from the inner surface of launch tube 12, as shown in greater detail in FIG. 2. At its greatest cross-sectional dimension, represented at section line 2—2 in FIG. 1, projectile 34 has a smaller diameter than the internal diameter of launch tube 12. A throat 36 is thus defined between the outer surface of projectile 34 and the inner surface of launch tube 12 at this point. Projectile 34 has a generally aerodynamic shape, diverging from a relatively sharp nose 38 at its forward end up to throat 36, and then converging toward its aft end. The aft end of projectile 34 is loosely seated against projectile-stop vanes 40, which prevent its retrograde motion upstream within starting chamber 14. Alternatively, a rod (not shown) can be disposed between the aft end of projectile 34 and a wave reflection disk 42 or other fixed structure within launch tube 12. Other structural elements within the launch tube can be employed to prevent retrograde movement of projectile 34.

Behind projectile 34 is disposed wave reflection disk 42, which is optionally prevented from moving upstream within the starting chamber by a plurality of spaced-apart tabs 44 that extend radially inward from the inner surface of launch tube 12. Tabs 44 are optional, since the mass of wave reflection disk 42 can be selected so that its inertia si sufficient to slow its retrograde movement, yet still enable it to reflect a shock wave. Also, wave reflection disk 42 can beheld in place by decreasing the diameter of launch tube 12 immediately upstream of it. In fact, wave reflection disk 42 can be eliminated by sufficiently necking down the neck-down portion, to reflect the expansion wave as a shock wave.

Details of wave reflection disk 42 are shown in FIGS. 3 and 4. A plurality of perforations 46 extend longitudinally through wave reflection disk 42, providing a restricted flow fluid path between its upstream and downstream surfaces. Wave reflection disk 42 includes a plate 48 that is loosely fitted in a depression formed in the disk to cover the upstream side perforations 46—at least until the plate is blown away from the disk by an expanding combustible gas mixture, as will be described.

Although straight chamber 14 may be filled with a relatively low pressure "inert gas" (i.e., non-combustible) such as carbon dioxide, a combustible gas mixture like that in first segment 16, but at relatively low pressure, may also be used. However, the starting chamber is evacuated in this preferred embodiment, leaving residual atmospheric gases (air) therein. In ram accelerator 10, a vacuum pump 50 is provided to exhaust air from starting chamber 14 so that it has less than one Torr pressure. Vacuum pump 50 is connected in fluid communication with starting chamber 14 at two points by vacuum lines 52 and 53 that are respectively attached to vacuum ports 54 and 55 on the side of launch tube 12. Use of two ports insures that pressure in starting chamber 14 is the same on both sides of wave reflection disk 42. In addition, a vacuum gauge 64 is connected to vacuum line 52 to monitor the pressure in starting chamber 14.

A fluid line 56 is connected at one end to a port 58. Port 58 provides fluid communication with an inter-membrane chamber 60, which is disposed between membranes **20*a* and 20*b*. The other end of fluid line 56 is connected through a normally closed solenoid valve 68. Alternatively, a normally closed, manually actuated valve may be used in place of solenoid valve 68. When solenoid valve 68 is opened, any pressurized fluid within inter-membrane chamber 60 is exhausted to atmospheric pressure. The purpose of solenoid valve 68** will be apparent from the following discussion.

First segment 16 is filled with a combustible gas mixture at a pressure at least a thousand time greater than the pressure within starting chamber 14. For example, the first segment can be filled with a combustible mixture comprising 2.5 moles of methane, 2 moles of oxygen and 6 mole of nitrogen at 75 atmospheres of pressure. Second segment 18 is filled with a different combustible gas mixture, selected so that it has characteristic acoustic speed (i.e., the speed of sound within the gas mixture) appropriate for further accelerating projectile 34 along the longitudinal axis of launch tube 12 using the ram acceleration process that is initiated in accordance with the present invention. Other segments within launch tube 12 are similarly filled with combustible gas mixtures of different densities, each thus having an appropriate characteristic acoustic speed for continuing the ram acceleration process.

To prepare ram accelerator 10 to accelerate projectile 34 to supersonic velocity using the ram acceleration process, vacuum pump 50 is energized until the pressure within starting chamber 14 is reduced to a pressure substantially less than one Torr. Vacuum gauge 64 is used to monitor the pressure within starting chamber 14.

In ram accelerator 10, membranes **20*a* and 20*b* have a characteristic burst pressure (e.g., 45 atmospheres) that is between the difference in the pressure of the combustible gas mixture within first segment 16 and the pressure within starting chamber 14. Thus, neither membrane 20*a* nor membrane 20*b* can withstand the differential pressure between first segment 16 and starting chamber 14. However, inter-membrane camber 60 is filled with fluid at a pressure approximately equal to one-half this differential pressure. For example, inter-membrane chamber 60 can be filled with fluid at a pressure of approximately 35 atmospheres. Consequently, each membrane 20*a* and 20*b*** is exposed to a differential pressure well below its burst pressure.

To initiate the same acceleration process, solenoid valve 68 is briefly opened, exhausting the fluid contained within inter-membrane chamber 60 to atmosphere. As soon as the pressure within inter-membrane chamber 60 falls sufficiently so that the pressure differential across membrane 20*b* is greater than its burst pressure, membrane 20*b* is perforated, thereby exposing membrane 20*a* to a pressure in excess of its burst pressure. Accordingly, membrane 20*a* is also perforate, enabling the combustible gas mixture within first segment 16 to expand nonsteadily into starting chamber 14. The rapid expansion of the combustible gas mixture involves well-known shock tube phenomena that produce an expansion wave. The expansion wave moves upstream, past throat 36 of projectile 34 at a supersonic velocity. Behind the expansion wave, the expanding combustible gas mixture flows past the projectile at throat 36 with a velocity in excess of Mach 1. Projectile-stop vanes 40, or other elements described above, prevent the expansion wave and combustible gas mixture from pushing the projectile upstream.

The expansion wave produced by the expanding combustible gas mixture proceeds upstream of projectile 34 until it impacts wave reflection disk 42, dislodging plate 48 from the surface of wave reflection disk 42. Plate 48 accelerates toward the distal end of the starting chamber. The wave reflection disk reflects the expansion wave downstream as a shock wave, back toward projectile 34. When the expanding combustible gas reaches wave reflection disk 42, stagnation or throttling of the expanding combustible gas mixture by perorations 46 and reflection of the shock wave by wave reflection disk 42 converts the kinetic energy of the gas mixture into thermal energy, producing a temperature sufficiently high to initiate combustion of the combustible gas mixture. The expansion wave reflected as a shock wave by wave reflection disk 42 propagates downstream and attaches to projectile 34, causing the projectile to begin accelerating down the launch tube. The reflected expansion wave thus establishes a stable, thermally choked ram acceleration as the combustible gas mixture burns adjacent the aft end of the projectile.

Figure 7:
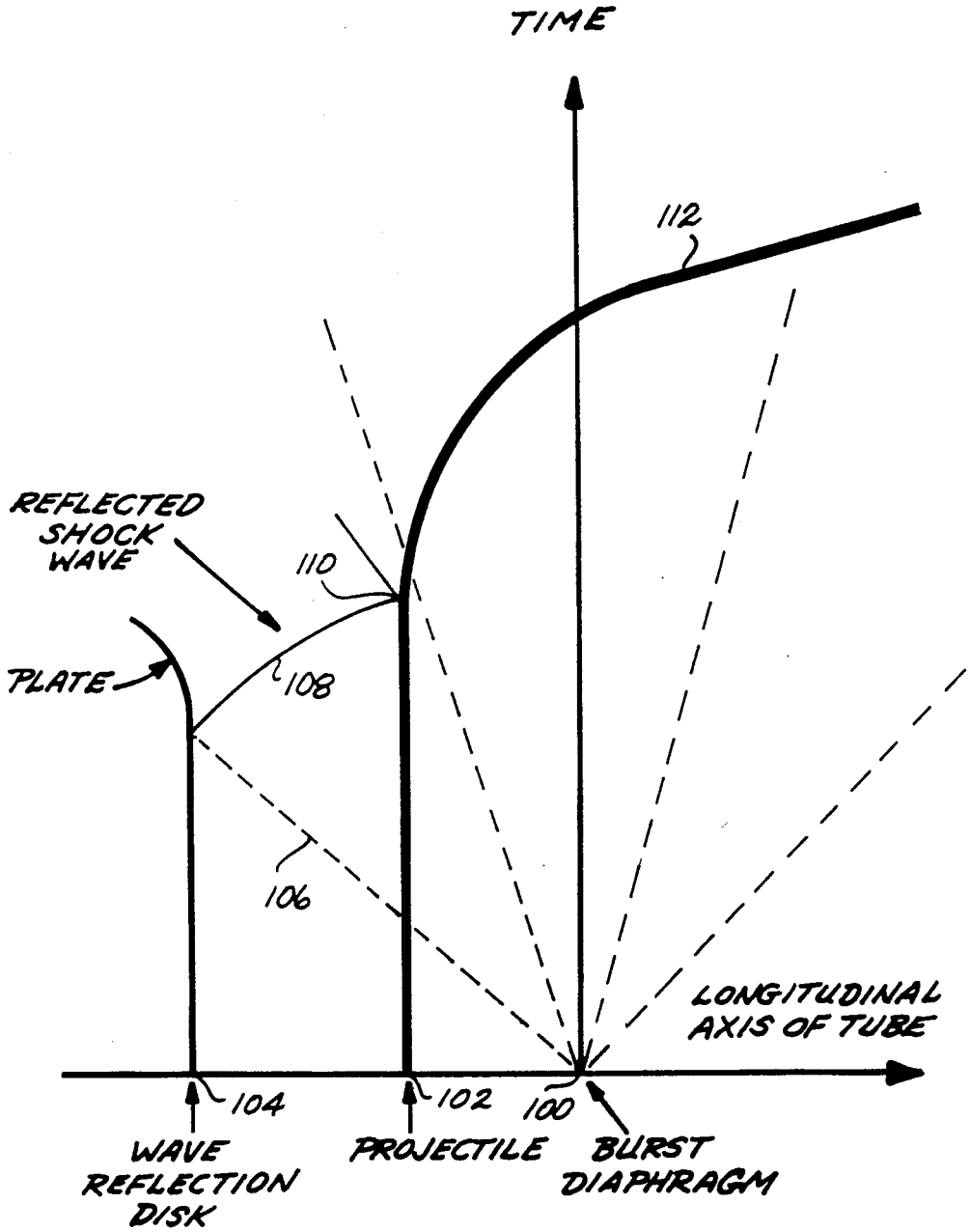
FIG. 7 graphically illustrates the relationship between time and the relative position of an expansion wave/shock wave and the projectile as ram acceleration is started.

FIG. 7 illustrates initiation of the ram acceleration process graphically from a time zero, when membrane 20*a* (at a position 100) is burst. Also at time zero, projectile 34 is at rest (at a position 102) and wave reflection disk 42 is disposed upstream (at a position 104—positions 100, 102, and 104 all being spaced apart along the longitudinal axis of the launch tube). An expansion fan 106 of the combustible gas mixture begins to propagate upstream within launch tube 12 from time zero. Expansion fan 106 passes the projectile at position 102, and is reflected by wave reflection disk 42, causing plate 48 to accelerate upstream in launch tube 12. A line 108 represents the shock wave reflected from wave reflection disk 42. The reflected shock wave attaches to projectile 34, as indicated at reference numeral 110. Ignition of the combustible gas mixture occurs shortly after the shock wave reflects from wave reflection disk 42. As the reflected shock wave starts the ram combustion process, projectile 34 accelerates down the longitudinal axis of the launch tube, as represented by a curve 112 in FIG. 7.

Projectile 34 proceeds through first segment 16, bursts through membrane 22, and enters second segment 18. The acoustic speed of the combustible gas mixture in second segment 18 enables the projectile to accelerate to even higher velocities. Ram acceleration of projectile 34 thus continues as it moves downstream along the longitudinal axis of launch tube 12, into each successive segment. Alternatively, second segment 18 can contain a gas mixture that varies in composition and characteristic acoustic speed along the longitudinal axis of launch tube 12. This variation allows projectile 34 to continue accelerating to higher velocities within second segment 18.

Although it is expected that the throttling effect caused by wave reflection disk 42 and plate 48 is likely to convert the kinetic energy of the expanding combustible gas mixture into thermal energy at a sufficiently high temperature to ignite the combustible gas mixture, an explosive charge or an electric spark device can also be used for this purpose.

Reflection of the expansion wave as a shock wave back downstream toward the projectile is important to initiate the ram acceleration process; however, it is also important that a portion of the kinetic energy of the expanding combustible gas mixture be dissipated so that the reflected shock wave attaches to the aft end of projectile 34 to maintain a subsonic flow of the combustible gas mixture past the projectile, to insure a stable combustion zone exists proximate its aft end. As noted in the Background of the Invention, other techniques can be used to establish and maintain the required subsonic flow past the projectile. For example, wave reflection disk 42 can be replaced with a relatively lightweight wave reflection disk 42'. Wave reflection disk 42' is shown in FIG. 5. If wave reflection disk 42' is used in place of wave reflection disk 42, tabs 44 are not required, since the lightweight wave reflection disk must be free to move upstream within starting chamber 14 after reflecting the expansion wave produced by the expanding combustible gas mixture. The mass of wave reflection disk 42' is selected so that it is sufficient to reflect the expansion wave, while dissipating a portion of the kinetic energy of the expanding combustible gas mixture and converting it to thermal energy that ignites the combustible gas mixture. Regardless of whether wave reflection disk 42 or wave reflection disk 42' is used, the wave reflection disk should be placed upstream of projectile 34 a distance equal to several diameters of launch tube 12. The specific distance required depends upon a number of operating parameters or conditions, including the combustible gas mixture used, the pressure differential between the combustible gas mixture in the first segment and fluid in the starting chamber prior to perforation of membranes 20*a* and 20*b* and other factors related to the scale (size) of the projectile and launch tube.

Instead of using a pair of membranes 20*a* and 20*b* to separate starting chamber 14 from first segment 16, a single membrane 20 may be used. In this case, port 58, fluid line 56, and solenoid valve 68 are not required. Instead, as shown in FIG. 6, a wire conductor 80 is applied on one surface of membrane 20 immediately adjacent to its periphery. Wire conductor 80 is conducted through a switch 82 to an electrical current source 84. To selectively perforate membrane 20, switch 82 is closed, causing electrical current to flow through wire conductor 80, thereby resistively heating the wire conductor to a temperature in excess of the melting point of membrane 20. When thus melted by wire conductor 80, membrane 20 perforates or bursts, allowing the combustible gas mixture within first segment 16 to expand into starting chamber 14 as already explained above. So long as the temperature of wire conductor 80 does not exceed the ignition temperature of the combustible gas mixture, the process for initiating ram acceleration is not affected. Due to the relatively small gauge of wire conductor 80, it has little effect on the flight of projectile 34 down launch tube 12.

Instead of using membranes 20 to separate starting chamber 14 from first segment 16, a fast-acting valve 120 can be used, as shown in FIG. 8. Fast-acting valve 120 includes a slide member 122 that is sealing seated in a channel 130, which is formed at the downstream end of starting chamber 14 and the upstream end of first segment 16. Slide member 122 thus prevents the combustible gas mixture contained within first segment 16 from leaking into the starting chamber. Slide member 122 includes a "T"-shaped head 124 that is disposed in a guide chamber 126, which extends upwardly from launch tube 12. Ports 132, disposed in the sides of guide chamber 126, provide fluid communication to ambient atmospheric pressure. A small explosive charge 128 is set between head 124 and the adjacent outer surfaces of the launch tube. When explosive charge 128 is ignited, fast-acting valve 120 is rapidly opened s slide member 122 is forced upwardly into guide chamber 126. The explosive charge is exhausted to atmospheric pressure through ports 132. As fast-acting valve 120 opens, the combustible gas mixture in first segment 16 expands into starting chamber 14, initiating the ram acceleration process as explained above.

Fast-acting valve 120 is intended to illustrate one type of such a valve; those of ordinary skill in the art will appreciate that many other designs for a fast acting valve could be used, including design as in which the valve is electromagnetically actuated or opened rapidly using fluid pressure developed other than by an explosive charge.

In the preceding description, the ram acceleration process is started with projectile 34 at rest within the tube. However, this invention is equally applicable to a projectile that is moving at a subsonic velocity when the ram acceleration process is initiated. For example, projectile 34 might be injected into launch tube 12 from a clip of such projectiles using a spring, for example, to eject the projectile from the clip. While this embodiment of the invention is not shown, it is mentioned to illustrate that the invention is not limited to starting the ram acceleration of a projectile that is absolute at rest, but instead, is equally applicable to starting the ram acceleration of a projectile moving at a subsonic velocity. The claims that follow should thus be read with sufficient breadth to encompass the scope of the invention.

Those of ordinary skill in the art will appreciate that these and other modifications to the present invention lie within the scope of the claims that follow. It is not intended that the invention in nay way be limited by the description of the preferred embodiments, but instead that it be determined entirely by reference to the claims and the remarks set forth above.

The embodiments of the invention in which an exclusive property or privilege is claimed are defined as follows:

1. Apparatus for accelerating a projectile using a ram acceleration process that starts with the projectile at rest, comprising:

(a) a launch tube that is longitudinally divided into a plurality of segments along its length, including a first chamber in which the projectile is positioned at rest, and an adjacent second chamber filled with a combustible gas mixture, the first chamber having a substantially lower fluid pressure than that of the combustible gas mixture within the second chamber;

(b) separation means for separating the first chamber from the second chamber;

(c) means for opening the separation means, allowing the combustible gas mixture to quickly expand into the first chamber from the second chamber, producing an expansion wave that passes the projectile within the launch tube at a supersonic velocity;

(d) wave reflection means, disposed behind the projectile in the first chamber, for reflecting the expansion wave as a shock wave back toward the projectile; and (e) means for igniting the combustible gas mixture behind the projectile as the expansion wave is reflected as a shock wave, the reflected shock wave starting the ram acceleration process as it reaches the projectile, so that the combustible gas mixture burns behind the projectile, continuously accelerating it longitudinally down the launch tube.

2. The apparatus of claim 1, wherein the separation means comprise a pair of thin membranes, closely spaced longitudinally along the launch tube, each of the membranes extending transversely across the launch tube, a fluid disposed between the pair of membranes having a pressure that is between the fluid pressure in the first chamber and the pressure of the combustible gas mixture in the second chamber, each membrane having a characteristic bursts pressure substantially less than the difference between the pressure of the combustible gas mixture in the second chamber and the fluid pressure in the first chamber.

3. The apparatus of claim 2, wherein the means for opening comprise valve means for reducing the pressure of the fluid between the pair of membranes, so that each membrane is exposed to a differential pressure substantially greater than its characteristic burst pressure, whereby the pair of membranes is burst, enabling the combustible gas mixture to rapidly expand from the second chamber into the first chamber.

4. The apparatus of claim 1, wherein the separation means comprise a material having a melting point temperature less than an ignition temperature of the combustible gas mixture, and wherein the means for opening comprise a wire disposed on the diaphragm means and a selectively energized current source connected to the wire to electrically heat the wire above the melting point temperature of the material comprising the diaphragm means, thereby perforating the material.

5. The apparatus of claim 1, wherein the wave reflection means comprise a disk disposed transversely across the launch tube behind the projectile.

6. The apparatus of claim 5, wherein the disk includes at least one orifice loosely covered by a plate that is disposed on an opposite side of the disk from that closer to the projectile, the inertial mass of the plate being sufficient to reflect the shock wave back toward the projectile as the plate is blown clear of the disk.

7. The apparatus of claim 6, wherein the means for igniting comprise said one or more orifices in the disk and the plate, the orifices restricting the flow of the combustible gas mixture therethrough, reflection of the expansion wave from the blast as a shock wave converting part of the kinetic energy of the combustible gas mixture expanding into the first segment into thermal energy, thereby raising the temperature of the expanding combustible gas mixture above its ignition temperature.

8. The apparatus of claim 1, further comprising means for preventing retrograde motion of the projectile within the launch tube as the expansion wave produced by the expanding combustible gas mixture flows pst the projectile toward the wave reflection means.

9. The apparatus of claim 8, wherein the means for preventing retrograde motion comprise a plurality of thin vanes that engage the projectile so as to prevent it moving upstream within the launch tube, but allowing it to move freely downstream in the launch tube as it experiences the ram acceleration process.

10. The apparatus of claim 1, wherein the means for igniting comprise a spark igniter.

11. The apparatus of claim 1, wherein the means for igniting comprise an explosive charge.

12. The apparatus of claim 1, further comprising successive chambers disposed downstream of the second chamber in the launch tube and separated from each other by thin membranes, the successive chambers being filled with combustible gas mixtures having different densities and thus different characteristic acoustic speeds, whereby the projectile enters the successive chambers by bursting the thin membranes and continues to accelerate to higher velocities as the combustible gas mixtures burn behind the projectile, thus effecting further ram acceleration of the projectile through the launch tube.

13. Apparatus for initiating a ram acceleration process to accelerate a projectile, comprising:

(a) a launch tube having a hollow bore extending longitudinally through it, the bore having a diameter greater than a portion of the projectile that is shaped to define a throat;

(b) a plurality of thin membranes, longitudinally spaced along the length of the launch tube bore, dividing the launch tube into a plurality of segments, the segments being filled with combustible gas mixtures of varying densities;

(c) a breech end of the launch tube bore including a starting chamber in which the projectile is disposed at rest as the ram acceleration process is started, the starting chamber having a substantially lower pressure than that of the combustible gas within an adjacent segment of the launch tube;

(d) means for perforating the membrane that separates the starting chamber from the adjacent segment of the launch tube, enabling the combustible gas mixture within the adjacent segment to expand into the starting chamber, producing an expansion wave having a supersonic velocity at a point where the expanding combustible gas mixture flows past the throat of the projectile;

(e) wave refection means disposed behind the projectile in the starting chamber, for reflecting the expansion wave produced by the expanding combustible gas mixture after it has passed the projectile as a shock wave, thereby converting the kinetic energy of the expanding combustible gas mixture into thermal energy that ignites the expanding combustible gas behind the projectile, thus initiating the ram acceleration process to propel the projectile into the adjacent segment of the launch tube, the projectile continuing to undergo ram acceleration through successive segments of the launch tube.

14. The apparatus of claim 13, wherein the wave reflection means comprise a perforated disk that is disposed within the starting chamber, and a plate that loosely covers a perforated portion of the perforated disk, the plate being blown clear of the perforated disk by the expanding combustible gas mixture after reflecting the shock wave back toward the projectile.

15. The apparatus of claim 13, wherein the wave reflection means comprise a lightweight disk having a mass sufficient to reflect the shock wave back toward the projectile as the disk is propelled backwards through the starting chamber, away from the projectile.

16. The apparatus of claim 13, further comprising a second membrane closely spaced from the membrane that is disposed between the starting chamber and the adjacent segment of the launch tube, a fluid pressure between said membrane and the second membrane being between the pressure in the adjacent segment and the pressure in the starting chamber, both said membrane and the second membrane having characteristic burst pressures that are each substantially less than the difference in pressure between the starting chamber and the first segment.

17. The apparatus of claim 16, wherein the means for perforating comprise a valve for exhausting a fluid from between the closely spaced membrane and the second membrane that separate the starting chamber from the first segment, so that each of said membranes is exposed to a differential pressure substantially greater than its characteristic burst pressures, causing said membranes to be perforated and allowing the combustible gas in the adjacent segment to expand into the starting chamber.

18. The apparatus of claim 13, wherein the means for perforating comprise a wire heated by an electrical current to a temperature sufficient to melt the membrane disposed between the starting chamber and the adjacent segment of the launch tube.

19. A method for accelerating a projectile through a launch tube that is filled with a combustible gas mixture, using a ram acceleration process that starts while the projectile is at rest, comprising the steps of:

(a) providing a starting chamber at an aft end of the launch tube in which the projectile is disposed at rest, the starting chamber being disposed adjacent a first segment of the launch tube that is filled with the combustible gas mixture at a pressure substantially greater than a fluid pressure in the starting chamber;

(b) rapidly releasing the combustible gas mixture from the first segment into the starting chamber downstream of the projectile, rapid expansion of the combustible gas mixture into the starting chamber creating an expansion wave that passes the projectile at a supersonic velocity;

(c) after the expansion wave has moved upstream past the projectile, reflecting the expansion wave back toward an aft end of the projectile as a shock wave, thereby covering a part of the kinetic energy of the expanding combustible gas mixture into thermal energy; and (d) igniting the expanding combustible gas mixture behind the projectile as the shock wave is reflected, so that the burning combustible gas and the reflected shock wave initiate the ram acceleration process to propel the projectile into the first segment of the launch tube.

20. The method of claim 19, wherein the step of rapidly releasing comprises the step of perforating a membrane that is disposed between the first segment of the launch tube and the starting chamber to enable the relatively higher pressure combustible gas mixture to flow from the first segment into the relatively lower pressure starting chamber.

* * * * *

UNITED STATES PATENT AND TRADEMARK OFFICE

CERTIFICATE OF CORRECTION

PATENT NO. : 5,097,743

DATED : March 24, 1992

INVENTOR(S) : Hertzberg et al.

It is certified that error appears in the above-identified patent and that said Letters Patent is hereby corrected as shown below:

| COLUMN | LINE(S) | |
|---|---|---|
| 3 | 65 | "aside" should be --a side-- |
| 4 | 4 | "gas mixture into" should be --wave as a shock-- |
| 4 | 48 | "wave" should be --valve-- |
| 4 | 59 & 60 | "(not shown )" should be (not shown)-- |
| 4 | 65 | "expand" should be --extend-- |
| 5 | 5 | after "also" insert --be-- |
| 5 | 50 | "si" should be --is-- |
| 5 | 52 | "beheld" should be --be held-- |
| 5 | 64 | after "side" insert --of-- |
| 6 | 29 | "time" should be --times-- |
| 7 | 6 | "perforate" should be --perforated-- |
| 7 | 28 & 29 | "perora-tions" should be --perforations-- |
| 8 | 55 & 56 | "con-ducted" should be --connected-- |
| 9 | 6 | "sealing" should be --sealingly-- |

UNITED STATES PATENT AND TRADEMARK OFFICE

CERTIFICATE OF CORRECTION

PATENT NO. : 5,097,743

DATED : March 24, 1992

INVENTOR(S) : Hertzberg et al.

It is certified that error appears in the above-identified patent and that said Letters Patent is hereby corrected as shown below:

| COLUMN | LINE(S) | |
|---|---|---|
| 9 | 29 | "design as" should be --designs--. |
| 9 | 44 | "absolute" should be --absolutely-- |
| 9 | 48 | "encompass the" should be --encompass this-- |
| 9 | 53 | "nay" should be --any-- |
| 10 | 29 | "bursts" should be --burst-- |
| 10 | 63 | "blast" should be --plate-- |
| 11 | 4 | "pst" should be --past-- |
| 12 | 52 | "covering" should be --converting-- |

Signed and Sealed this

Thirty-first Day of August, 1993

Bruce Lehman

*Attest:*

BRUCE LEHMAN

*Attesting Officer*

*Commissioner of Patents and Trademarks*